US005505663A

United States Patent [19]

Goulart et al.

[11] Patent Number: 5,505,663

[45] Date of Patent: Apr. 9, 1996

[54] SELF OPERABLE TRANSFER SYSTEM FOR THE DISABLED

[76] Inventors: Gabriel M. Goulart, 435 36th St., Richmond, Calif. 94805; Andrew Mioduchowski, 505 High St., Albuquerque, N.M. 87102

[21] Appl. No.: 222,877

[22] Filed: Apr. 5, 1994

[51] Int. Cl.[6] ..... A63G 21/00

[52] U.S. Cl. ..... 472/116; 14/70

[58] Field of Search ..... 472/116, 117; 14/70, 69, 72.5; 19/321, 324; 193/35 A; 414/528, 537, 921

[56] References Cited

U.S. PATENT DOCUMENTS

| | | | |
|---|---|---|---|
| 1,184,566 | 5/1916 | Payton . | |
| 1,380,731 | 7/1921 | Miller . | |
| 3,298,495 | 1/1967 | Acton | 198/321 |
| 3,414,108 | 12/1968 | Jackson et al. | 198/321 |
| 3,530,799 | 9/1970 | Braun | 198/321 X |
| 4,865,312 | 9/1989 | Katz | 472/116 |
| 5,118,244 | 6/1992 | Cook | 198/835 X |

OTHER PUBLICATIONS

PCA Industries, Inc., Catalog 194, p. 14.
Park Structures Inc., Catalog 11, Building Today to Satisfy Tomorrow's Toughest Customers, pp. 19 and 25.
BigToys Catalog No. 18, pp. 51, 52 and 53.
Iron Mountain Forge Buyer's Guide, 16th Edition, p. 77.

*Primary Examiner*—Kenneth J. Dorner
*Assistant Examiner*—Kien T. Nguyen
*Attorney, Agent, or Firm*—Robert A. Felsman

[57] ABSTRACT

A playground apparatus having a departure platform accessible by a person in a wheelchair, a transfer platform at a remote location, conveyor to transport the person between the platforms and a play apparatus to return to the departure platform. The conveyor is unidirectional to permit only upward movement and a handrail extends along the conveyor for pushing or pulling upwardly. The conveyor is inclined, having a belt on rollers, one of which is unidirectional. A clutch in the roller permits movement of the belt only in the upward direction. A handrail is used is used to pull or push upwardly and a slide used to return the person to the departure platform and the wheelchair.

13 Claims, 2 Drawing Sheets

SELF OPERABLE TRANSFER SYSTEM FOR THE DISABLED

BACKGROUND OF THE INVENTION

1. Field of the Invention

This invention is in general a system that enables disabled persons to transfer themselves without assistance from one location to another, especially from one elevation to another in a playground environment for using equipment otherwise inaccessible to the impaired.

2. Background Information

The American Disabilities Act of 1990(ADA 90)requires that municipal, state and federal parks and playgrounds become accessible to the disabled. Most playground equipment uses wheel chair ramps in an attempt to solve the accessibility issue of getting participants on and off playground climbing structures.

The major problem with ramps is that while disabled participants can gain with them access to elevated playground equipment, it is usually necessary to abandon a wheelchair to use the equipment. When using a slide, for one example, a disabled participant vacates the wheelchair at the ladder of the slide, climbs the ladder with great difficulty, if at all, and slides to the ground at a location removed from the wheelchair with only extremely difficult ability to return to the wheelchair without assistance.

Integrating disabled children into accessible playgrounds and playground equipment has been an intermittent and loosely defined goal for approximately one hundred years. But only since the late 1940's has there been an active movement to appropriately accommodate disabled children in playgrounds. Legislation in the 1960's and 70's initially targeted accessibility issues within the context of civil rights laws. Only with the passage of ADA 90 has accessibility finally been mandated by the U.S. Government.

The initial response to the issue of accessibility, and integration of handicapped with the able-bodied, focused on institutionalization that contained a "separate but equal" approach. Institutionalization began to give way in the 40's and 50's to the creation of a system of workshops that only dealt with simple games for recreation. The 60's and 70's saw specialized playgrounds designed for specific institutions and capabilities—focusing on activity achievement with little thought given to integration. The 80's and 90's have initiated a new era when access is the main focus.

Unfortunately, access has been limited to the root formula of moving a participant from point A to point B with little thought of the actual goal of integration. A series of long, difficult ramps is the most common approach to providing accessibility for the disabled participant. This approach, although satisfying the letter of the law, does not deal with the practicalities of true accessibility and integration for able bodied as well as disabled participants.

Past strategies and methods dealt with accessibility only by creating other barriers at different areas of play. Access should be at every point of the playground and play area and not only at the play initialization areas. Lay terms define this as an access to the play loop or path that takes a participant from one play apparatus from start to finish, then to another play apparatus and so on, returning the participant to the place of origin where a wheelchair may be parked.

Past technology only extends the play accessibility issue to the next illogical barrier, i.e. ,ramps that transport the individual to the start of a play apparatus via wheelchair but leaves the wheelchair parked at another point of the apparatus. This excessively challenges the participant to not only negotiate the next play area, but also, to retrieve the wheelchair from a remote area of abandonment. In the best known example of this approach is an "Up/Down Crawl Through" which uses an inclined plane and a "tunnel rung/handrail" to facilitate movement of an impaired person up the plane by pushing or pulling along the handrail. The plane must be only gradually inclined to prevent excessive exertion and rapid loss of interest.

SUMMARY OF THE INVENTION

It is therefore the general object of the invention to provide for the disabled a transfer system that will enabled convenient and safe use without assistance of otherwise conventional apparatus such as playground equipment. An object is to free participants from the confines of a wheelchair, ramp or other assisted device and allow movement from the ground to an elevated playground apparatus or from one playground apparatus to another. An accessibility path is created that may be used by both able bodied and handicapped participants and becomes a part of the apparatus that may help develop strength and endurance. This is achieved with a playground apparatus having a departure platform accessible by a person in a wheelchair, a transfer platform at a remote location, conveyor means to transport the person between the platforms and a play apparatus to return to the departure platform. The conveyor means is unidirectional to permit only upward movement and a handrail extends along the conveyor for pushing or pulling upwardly.

The above as well as additional objects, features, and advantages of the invention will become apparent in the following detailed description.

DETAILED DESCRIPTION OF THE INVENTION

Figure 1:
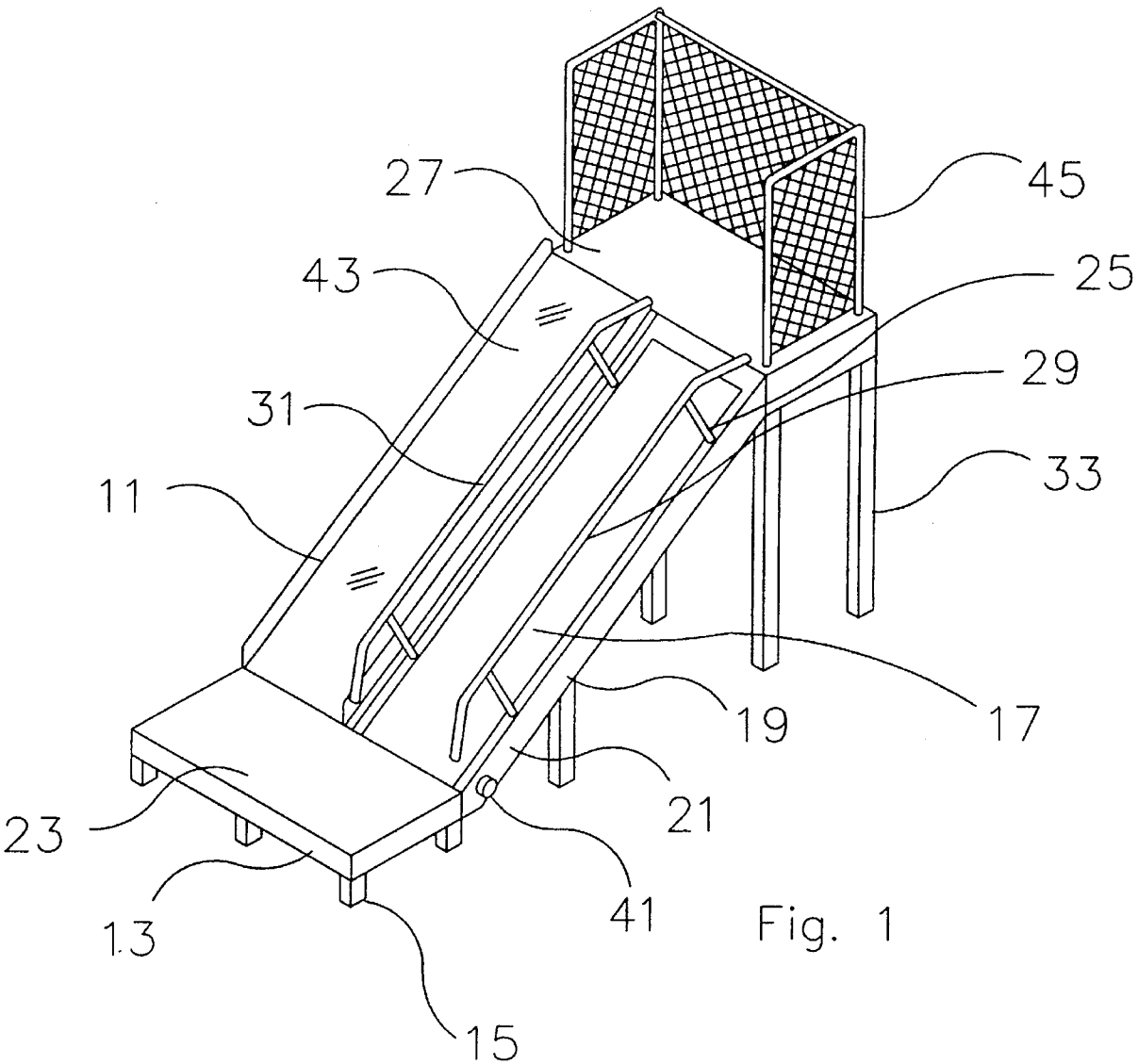
FIG. 1 is a perspective view of playground apparatus that embodies the features of the invention.

With reference now to the drawings and in particular with reference to FIG. 1, the numeral 11 designates a playground apparatus that contains a departure platform 13 supported on legs 15 at an elevation accessible to a disabled person in a wheelchair. That is, a person in a wheelchair may move normally onto the departure platform with relative ease and without assistance, assuming the physical impairment did not result in substantial paralysis of the arms.

A conveyor belt 17 is supported on a carriage 19, inclined at a selected oblique angle, with a lower end 21 adjacent the upper surface 23 of the departure platform 13 and an upper end 25 adjacent a transfer platform 27 at a remote, elevated location from the departure platform 13.

A pair of handrails 29, 31 are supported above and along the length of the carriage 19, which with the transfer platform 27 is supported by suitable legs 33. Both the departure and transfer platforms 13, 27 are constructed of preferably stainless steel or some other durable material with a relatively low coefficient of friction.

Figure 2:
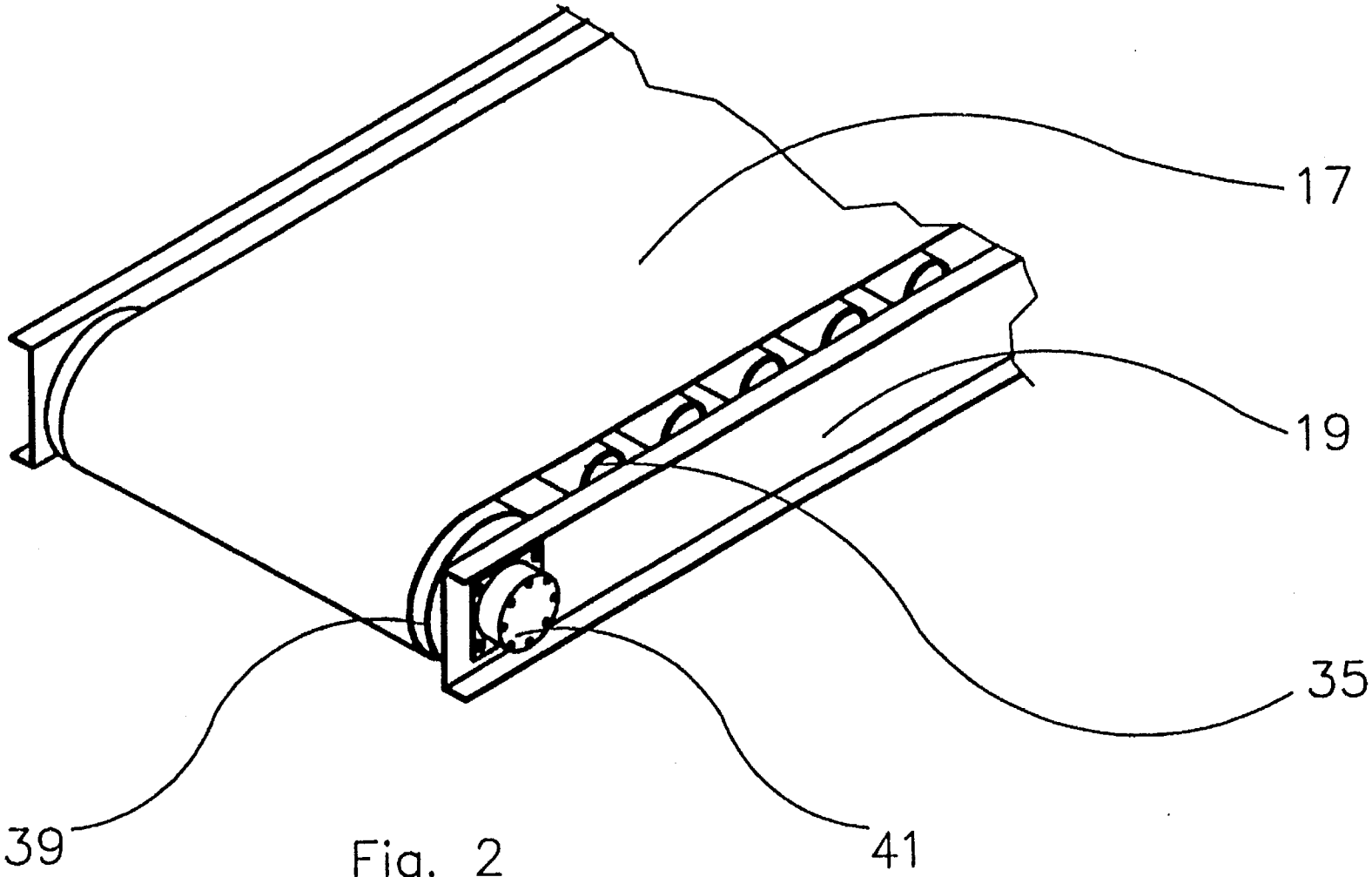
FIG. 2 is fragmentary, enlarged view of a portion of the apparatus of FIG. 1, showing a conveyor and rollers, the lower of which contains a clutch to limit movement on the conveyor belt to the upward direction.

Supported by the carriage 19 upon a series of rollers 35 (see FIG. 2) is the conveyor belt 17 of conventional reinforced conveyor belt material. The lowermost roller 39 (see FIG. 2) is unidirectional, containing preferable a sprag clutch mechanism 41 that engages to prevent rotation in one direction and enable rotation in the other direction. As seen in FIG. 2, the roller 39 will rotate in the clockwise direction but not in the counterclockwise direction. Thus, the upper part of the conveyor belt loop will move only in the upper direction but not in the downward direction.

The clutch in the unidirectional roller 39 is preferably of the type referred to as a sprag clutch and is available from manufactured by Dodge, Part No. 290V21. There are a variety of clutch mechanisms and ratcheting devices that can be used to accomplish unidirectional rotation of the roller 39.

Parallel to the conveyor belt 17 is a conventional slide 43 having its upper end adjacent to the transfer platform 27 and its lower end adjacent to the departure platform 13. Supported on the outer edges of the transfer platform 27 is a safety barrier 45.

In operation, the playground apparatus of FIGS. 1 and 2 is accessible to a disabled person, who enters the departure platform 13 after parking a wheelchair adjacent to the upper surface 23. Then, the disabled person uses the handrails 29, 31 to pull or push upwardly, causing movement of the upper surface of the conveyor belt 17 to move upwardly toward the transfer platform 27. The sprag clutch mechanism 41 of the lower roller 39 causes unidirectional movement of the belt to resist regression of the person downwardly and toward the departure platform 13. Once the transfer platform 27 is reached, the person moves laterally and onto the slide 43, sliding to the departure platform 13 to return to the conveyor belt 17 or to the wheelchair. The invention has the advantage of easily enabling a disabled person to have access to the slide with a wheelchair, to utilize the play apparatus and return to the wheelchair without assistance.

While the invention has been shown in only its preferred form, it should be apparent to those skilled in the art that it is not thus limited, but is susceptible to various changes and modifications without departing from the spirit thereof.

What is claimed is:

1. Playground apparatus accessible to a disabled person in a wheelchair, comprising:

a departure platform having a surface at an elevation near ground accessible by the person in the wheelchair;

a transfer platform at an elevation above the departure platform;

a conveyor accessible by the person with a lower end adjacent the departure platform and an upper end adjacent the transfer platform to convey the person to the transfer platform;

means for enabling self-propelled movement upward of the conveyor by the person from the departure to the transfer platform;

means adjacent the conveyor to permit self-propelled and intermittent upward movement by the person toward the transfer platform and prevent downward movement toward the departure platform;

a play apparatus with an upper end adjacent the transfer platform and a lower end adjacent the departure platform that transports the person during play from the transfer platform to the departure platform;

whereby the person may without assistance reuse the conveyor and play apparatus or return to the wheelchair.

2. The invention defined by claim 1 wherein the conveyor comprises a conveyor belt on rollers, one of which rollers rotates unidirectionally to enable only upward movement.

3. The invention defined by claim 2 wherein the unidirectional roller contains a clutch that engages to prevent rotation in one direction and enable rotation in the other direction.

4. The invention defined by claim 2 wherein hand holds extend along the conveyor to enable the person to push or pull upward to move the conveyor belt upward.

5. The invention defined by claim 4 wherein the hand holds comprise a pair of rails for pushing or pulling upwardly.

6. The invention defined by claim 1 wherein the play apparatus comprises a slide.

7. Playground apparatus accessible to a disabled person, comprising:

departure platform means in one location at an elevation near ground to receive the disabled person from a wheelchair without assistance from another;

transfer platform means to receive the disabled person at a higher elevation;

conveyor means with one region adjacent the departure platform means to transfer the person to the transfer platform means;

means associated with the conveyor means for permitting unidirectional, upward movement of the person on the conveyor means and to resist regression of the person downwardly toward the departure platform means;

self-propelled means for movement of the conveyor means and the person from the departure platform means to the transfer platform means;

play means to entertain and transports the person during play from the transfer platform means to the departure means whereby the person may without assistance reuse the conveyor and play means or return to the wheelchair.

8. The invention defined by claim 7 wherein the conveyor means comprises a belt on rollers, one of which rotates unidirectionally as said self-propelled means and to enable only upward movement.

9. The invention defined by claim 8 wherein the unidirectional roller contains a clutch that engages to prevent rotation in one direction and enable rotation in the other.

10. The invention defined by claim 9 wherein the play means comprises a slide with one end adjacent the transfer platform means and the other end adjacent the departure platform means to enable the person to move onto the conveyor means after sliding downward or to return to the wheelchair without assistance.

11. The invention defined by claim 10 wherein a hand rail extends along the belt to enable the person to push or pull upward to move the belt upward.

12. The invention defined by claim 11 wherein the hand rail comprises a pair of rails.

13. Playground apparatus accessible to a disabled person in a wheelchair comprising:

a departure platform near ground level to receive the disabled person from a wheelchair without assistance from another;

a transfer platform to receive the disabled person at a higher elevation;

a self-propelled conveyor belt with one end adjacent the departure platform to transfer the person to the transfer platform while resisting regression toward the departure platform;

a clutch mechanism to prevent the conveyor belt from moving downwardly;

a hand rail along the belt conveyor to enable self-propelling upward movement;

a slide extending form the transfer platform to the departure platform to return the departure platform whereby the person may without assistance reuse the conveyor and play apparatus or return to the wheelchair.

* * * * *